US010427764B2

(12) United States Patent
Tang

(10) Patent No.: US 10,427,764 B2
(45) Date of Patent: Oct. 1, 2019

(54) WATERSPORTS BOARD

(71) Applicant: Kam Tim Tang, Hong Kong (HK)

(72) Inventor: Kam Tim Tang, Hong Kong (HK)

( * ) Notice: Subject to any disclaimer, the term of this patent is extended or adjusted under 35 U.S.C. 154(b) by 0 days.

(21) Appl. No.: 15/944,768

(22) Filed: Apr. 3, 2018

(65) Prior Publication Data

US 2018/0297672 A1 Oct. 18, 2018

(30) Foreign Application Priority Data

Apr. 18, 2017 (HK) ..... 17103936.2

(51) Int. Cl.

| | |
|---|---|
| ***B63B 35/81*** | (2006.01) |
| ***A63C 5/03*** | (2006.01) |
| ***B63B 35/79*** | (2006.01) |
| ***A63C 5/04*** | (2006.01) |
| ***A63C 5/02*** | (2006.01) |
| ***A63C 5/12*** | (2006.01) |

(52) U.S. Cl.

CPC ..... *B63B 35/7926* (2013.01); *A63C 5/02* (2013.01); *A63C 5/04* (2013.01); *A63C 5/126* (2013.01); *B63B 35/793* (2013.01); *B63B 35/7906* (2013.01); *B63B 35/7916* (2013.01); *A63C 5/03* (2013.01)

(58) Field of Classification Search

CPC . B63B 35/79; B63B 35/7906; B63B 35/7926; B63B 2035/79; B63B 2035/7903; B63B 2035/81; B63B 2035/813; B63B 2035/818; B63B 2035/855; A63C 5/03; A63C 5/04

USPC ..... 441/65, 68, 74, 76, 79

See application file for complete search history.

(56) References Cited

U.S. PATENT DOCUMENTS

| | | | | |
|---|---|---|---|---|
| 4,807,549 | A * | 2/1989 | Rhodes | B63B 35/7916 114/352 |
| 6,241,568 | B1 * | 6/2001 | Simms | B63B 35/7913 441/66 |
| 6,338,682 | B1 * | 1/2002 | Torchia | A63B 67/02 473/160 |
| 7,121,909 | B1 * | 10/2006 | Meyerhoffer | B63B 35/7916 441/74 |
| 7,331,835 | B2 * | 2/2008 | Renard | B63B 35/7909 114/357 |
| 7,845,999 | B2 * | 12/2010 | Conner, Jr. | B32B 3/12 441/74 |
| 8,123,580 | B1 * | 2/2012 | Meyerhoffer | B63B 35/7916 441/74 |
| 8,272,907 | B2 * | 9/2012 | Lindstrom | B63B 35/7916 114/352 |
| 9,650,114 | B1 * | 5/2017 | Maresh | B63B 35/7906 |

(Continued)

FOREIGN PATENT DOCUMENTS

JP 2004345616 A 12/2004

*Primary Examiner* — Daniel V Venne

(57) ABSTRACT

The present invention provides a kind of sports equipment, particularly sports equipment for water sport or snow sport, comprising a main body made of light rigid material and having at least one built-in framework that is harder than the main body. The sports equipment further comprises a deck fixed on the top surface of the main body and configured to be harder than the main body. Compared with prior sport equipment, the equipment of the invention has the advantages such as light weight, durability, collision resistance and easy handling.

9 Claims, 9 Drawing Sheets

(56) References Cited

U.S. PATENT DOCUMENTS

| | | | | |
|---|---|---|---|---|
| 2007/0155261 | A1* | 7/2007 | Cheung | B63B 13/00 441/65 |
| 2008/0280096 | A1* | 11/2008 | Metrot | B29C 44/06 428/127 |
| 2009/0165697 | A1* | 7/2009 | Caldwell | B63B 5/24 114/65 R |
| 2017/0190394 | A1* | 7/2017 | Cheung | B32B 5/06 |

* cited by examiner

WATERSPORTS BOARD

CROSS REFERENCE TO RELATED APPLICATIONS

The present application claims the benefit of Hong Kong Patent Application No. 17103936.2 filed on Apr. 18, 2017. All the above are hereby incorporated by reference.

TECHNICAL FIELD OF THE INVENTION

The present invention relates to the field of sports equipment, and more particularly, to sports equipment that can be used on water and snow.

BACKGROUND OF THE INVENTION

People are showing more interest in water and snow sports. Popular water and snow sports include sailing, windsurfing, water skiing and snowboarding. Most water and snow sports require the use of board type sports equipment, such as aquaplanes, snowboards, and boats. Since people often need to move the aquaplanes, snowboards, and other sports equipment when they are performing water and snow sports, the requirements for such sports equipment are light weight and enough firmness to resist the collision and withstand user's weight. Besides, because water sports and snow sports are mostly performed outdoors, the sports equipment also should be able to withstand the tests of the harsh environment in the nature. Therefore, water and snow sports equipment must be made of materials that meet the requirements for resistance to acid, alkali and seawater erosion, and can withstand the long-term exposure to UV light from the sun, low temperature, high temperature, etc., to ensure long-term use.

All the time, it is very difficult for sports equipment to take into account both lightweight and firmness. For example, a board has a volume of 120 cubic centimeters, but its weight is about 9 kilograms, that is, the material weight per cubic decimeter can only be 75 grams. Therefore, the materials used are all materials with very low density. It appears very difficult to ensure that the product is hard. The current manufacturing methods and the materials selected are held back by light weight or firmness and often have to sacrifice one in order to satisfy the other.

As a major production method of water and snow equipment at present, fiber reinforced thermosetting engineering plastic is used for the surface of the board core made of foam material to obtain a thin casing wrapping the core. The casing and the core are bonded together to form a firm and integral body. It adopts the structural principle of eggs, i.e., although the casing is very thin, it still has extraordinary firmness due to an integral structure. The equipment produced by using this principle may have a relatively light weight under the precondition of a large volume and certain hardness.

Such existing equipment has defects in materials, structural design and production method and is bulky, making storage and handling difficult. The main problems are as follows:

Firstly, the existing equipment has to sacrifice firmness in order to achieve a light weight. As a result, the casing is thin, which is liable to damage by external force. However, because water sports and snow sports are intense sports, it is difficult to avoid collision. Consequently, the existing water and snow sports equipment is not durable.

Secondly, the casing of the existing equipment is made of fiber reinforced thermosetting engineering plastic. The production of thermosetting plastic is highly dependent on manual operation, has very strict requirements for the level of skill and concentration of the operators and the blending accuracy of chemicals, and is sensitive to weather, temperature, humidity and other factors. A small mistake may lead to defective products. Moreover, once thermosetting plastic completes chemical reactions and is hardened, it cannot be corrected any more. Defective products will face the result of overall scrapping. The existing production methods have the disadvantages of cost control such as a high product rejection rate, and overall scrapping of defective products.

Thirdly, the existing equipment is based on the structural principle of eggs. The egg has an integral structure. Although the eggshell is thin, it can have a certain degree of firmness. However, if the thin shell of the existing equipment is damaged, no matter how small the damaged area is, the integral structure will be lost. The damaged area is the source of subsequent damage expansion, and the equipment will eventually face the result of overall scrapping.

Fourthly, such equipment is bulky in general, it is difficult to take care of both its head and tail during moving. As it is easy to damage due to its thin shell, it has to be wrapped with heavy protective materials during transport and carriage. The packaging will make it more bulky and heavier, resulting in inconvenience of transportation and carrying.

SUMMARY OF THE INVENTION

The main object of the present invention is to provide a firm, durable and light sports equipment for water sports or snow sports.

In order to realize the foregoing main object, the present invention provides sports equipment comprising a main body made of foam material, in which at least one framework that is harder than the main body is disposed. The equipment further comprises a deck that is fixed on the top surface of the main body and is configured to be harder than the main body.

Preferably, the main body at least comprises a detachable first portion and a detachable second portion, which both are provided with a slot, and the framework may be inserted thereinto. The deck at least comprises a detachable first deck and a detachable second deck.

Preferably, the main body is fixed and connected to the deck by fixing members in a detachable manner.

Further, positioning grooves are arranged on the top surface of the main body, positioning bulges are arranged on the bottom surface of the deck, which are buckled with the positioning grooves.

Preferably, the framework is in an elongated shape, and the slots of the first portion and the second portion of the main body are both in an elongated shape for receiving the framework, which are extended along the length direction of the main body.

Further, the main body together with the framework is fixed and connected to the deck by locking members in a detachable manner.

Further, the main body is provided with grooves for receiving the locking members, and through holes are arranged in the middle part of the locking members to allow the passage of the framework. Screws are arranged on the side of the locking members facing towards the deck, which are configured to pass through the corresponding holes arranged on the deck and are fastened to the deck by nuts.

Further, the sports equipment has two frameworks, which are separately mounted in two slots that are arranged on the main body and extended parallel along the length direction of the main body.

Further, each of the frameworks consists of three sections, the head section and the tail section are arranged in the first portion and second portion of the main body respectively and the middle section is mounted in the first portion and the second portion.

Preferably, at last one accessory is mounted on the deck directly or after passing through the main body.

The present invention also provides sports equipment, comprising a main body made of light and rigid material, a deck fixed on the top surface of the main body and configured to be harder than the main body, and at least one framework located in the main body and configured to be harder than the main body.

Preferably, the main body is made of foam material.

Preferably, the main body is fixed and connected to the deck by fixing members in a detachable manner.

Further, the framework is in an elongated shape, and the main body is provided with elongated slots extending along its length direction for receiving the framework.

Further, the fixing members are locking members, by which the main body together with the framework is fixed and connected to the deck.

Further, the main body is provided with grooves for receiving the locking members, and through holes are arranged in the middle part of the locking members to allow the passage of the framework. Screws are arranged on the side of the locking members facing towards the deck, pass through the corresponding holes arranged on the deck and are fastened onto the deck by nuts.

The sports equipment of the present invention uses light material with certain stiffness, foam material for example, to make a main body, rather than uses foam material as the core as the existing equipment does. Moreover, not like the existing equipment, which adopts a hard casing wrapping a foamed core, the sports equipment provided in the present invention is provided with a hard deck on the surface of a main body made of foam material, a hard framework is provided in the main body, and the main body, the deck and the framework are connected into an integral body via locking members.

Not like the existing equipment, which installs different accessories necessary for movements on a main body, the sports equipment provided in the present invention installs accessories on a hard deck. As the main body made of foam material is integrated with the hard deck, the accessories are equivalent to being installed on the main body.

As the present invention uses foam material to make a main body of the sports equipment, it meets the two requirements for sports equipment: light weight and durability. However, the sports equipment made of foam material has a few limitations, for example, the material is too soft to install accessories and lacks longitudinal stiffness when the body is long, and the top surface of the soft material is not suitable for bearing weight or for stable standing of a user on the sports equipment. To address the foregoing limitations, the present application arranges a hard framework in the main body, and a hard deck on the main body, and uses locking members to fix the framework and the deck onto the main body to form a piece of integrated equipment and give full play to the foam material as the main body of the sports equipment.

The present invention chooses foam material to directly make the main bodies of aquaplanes, snowboards, boats and other sports equipment. As foam material has numerous obvious advantages, including light weight, durability, not absorbing water, never sinking, having sufficient elasticity to buffer the collision during movement and handling, and resistance to acids, alkalis, seawater, UV light, low and high temperature and other harsh environments, it is an ideal material for sports equipment for water and snow sports.

However, as foam material is soft and of low density, it will face the following three limitations when it is used as a main body of sports equipment. The present invention provides the following solution to make up the limitations of the foam material:

The low density and soft texture of foam material may cause the problem of inadequate longitudinal stiffness and hardness of long sports equipment. For example, a standing skateboard or sailboard is 2.5 m to above 3 m long in general, but only 15~20 cm thick. The board body made of foam material alone in such length and thickness will have low longitudinal stiffness and hardness. When there is an external force, it will be bent and jitter or sway, be deformed as a whole and deviate from the originally designed shape, and the use effect will be poor and even the basic sports effect cannot be achieved.

To address the foregoing defects, the present invention arranges a hard framework inside a main body made of soft foam material, and a hard deck on the surface of the main body, and then uses locking members to firmly lock the framework and the deck onto the main body, providing enough longitudinal stiffness and hardness.

To address the problem that it is difficult to stably and firmly install accessories (including, but not limited to: central board box, tail fin box, universal joint connection box, sliding track, foot muff fixing piece, pull rope fixing piece, stern rudder and hydrofoil) on the main body made of foam material with low density and soft texture, for example, the accessories are liable to being pulled out or off by external force, according to the present invention, accessories are not mounted directly on the soft main body made of foam material, but on a firm and hard deck. Fixing accessories on a deck can meet the functional requirements of the accessories. Through locking members, the deck and the main body made of foam material are connected to form an integral body, and the accessories are same as being mounted on the main body. In this way, not only the requirements for firm mounting of accessories are met but also the fixation and connection of the accessories and the main body can be assured.

To address the problem that due to the low density and soft texture of foam material, when a user stands on the boat surface, the surface will depress under the weight of the user and the user can hardly stand stably, the present invention is to fix a firm deck on the main body so that the deck carries user's weight and can endure the impact generated from downward strike of jump wave, and the user can stably stand on the boat surface.

To sum up, the hard framework is used in the sports equipment of the present invention can create the following two effects: strengthening the longitudinal stiffness and hardness of the main bodies of board type or boat type sports equipment, and using as an anchor point for the connection of the hard deck to the main body.

The adoption of the hard deck creates the following five effects: Firstly, it strengthens the longitudinal stiffness and hardness of the main body. Secondly, it is used for mounting of accessories. Thirdly, it is used to carry user's weight. Fourthly, it is for standing of the user. Fifthly, it realizes connection between the front section and the rear section of the main body if the main body is divided into a front section and a rear section, to avoid separation of the two sections of the main body.

BRIEF DESCRIPTION OF THE DRAWINGS

The present invention will now be further described by referring to the accompanying drawings and embodiments, wherein.

DETAILED DESCRIPTION OF THE INVENTION

The sports equipment provided in the present invention is a kind of sports equipment used on water or snow, which may be flat sports equipment, such as standing skateboard, surfboard, sailboard, kite board, aquaplane, snowboard, and may also be non-flat sports equipment, such as small boat, small sailboat and kayak.

Embodiment 1

Figure 1:
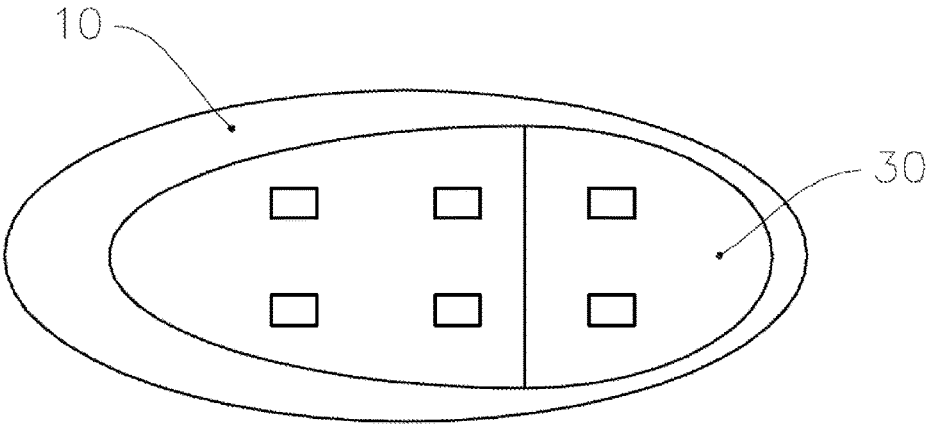
FIG. 1 is a schematic view of the first embodiment of the present invention.
Figure 2:
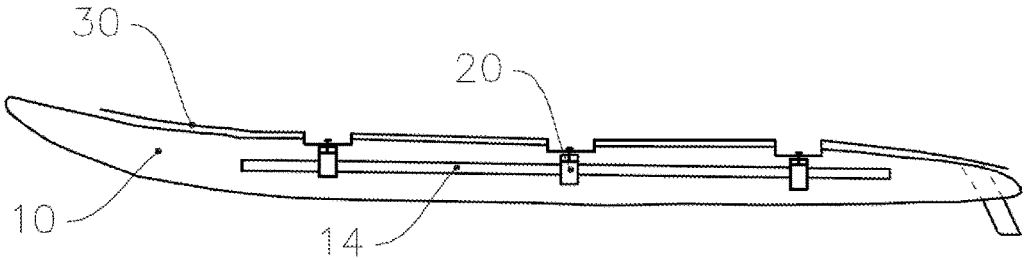
FIG. 2 is a schematic view of the first embodiment of the present invention at another angle of view.

As shown in FIG. 1 and FIG. 2, the sports equipment in this embodiment is a skateboard or sailboard on which a person can stand. It has a flat main body 10 made of light and rigid material, for example, foam material—ethylene vinyl acetate copolymer (EVA). As foam material has the advantage of low density, a main body 10 made of foam material can effectively reduce the weight of the sports equipment. A deck 30 is arranged on the main body 10. In this embodiment, the deck 30 is made of hard material, for example, glass fiber reinforced epoxy resin, and is harder than the main body 10.

FIG. 2 shows that a framework is arranged inside the main body 10 made of foam material.

Figure 3:
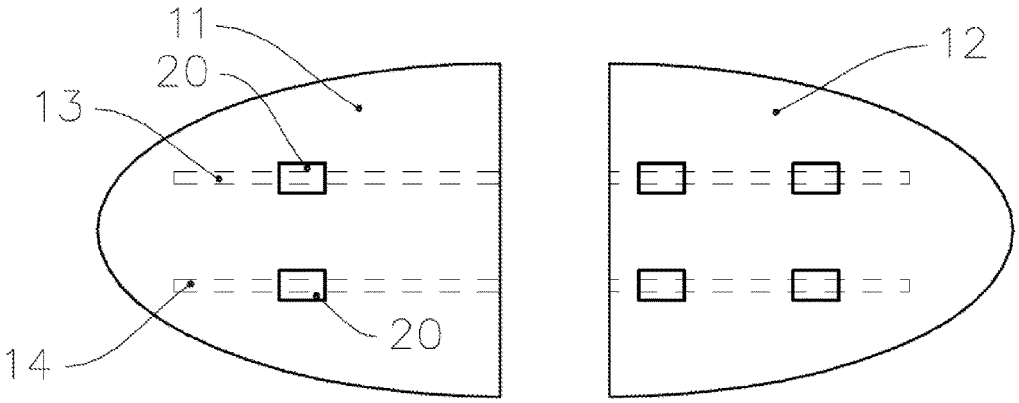
FIG. 3 is a schematic view of the first portion and the second portion of the main body in the first embodiment of the present invention.

As shown in FIG. 3, the main body 10 is substantially in an oval shape and comprises a first portion 11 and a second portion 12, which are connected in a detachable manner. In other words, the first portion 11 may be detached other than not detached from the second portion 12. Two slots 13 & 14 are arranged on the main body 10 and parallel with each other along the length direction of the main body 10. Preferably, the two slots 13 & 14 are both arranged inside the main body 10. That is to say, they are not visible outside the main body 10. Besides, one part of the slot 13 is inside the first portion 11 and the other part is inside the second portion 12. Likewise, one part of the slot 14 is inside the first portion 11, and the other part is inside the second portion 12.

In this embodiment, the main body 10 is made of soft foam material. In order to enhance the hardness of the main body 10, two frameworks 17 & 18 are arranged on the main body 10, specifically, the framework 17 is arranged inside the slot 13, and the framework 18 is arranged inside the slot 14. As the slot 13 is parallel with the slot 14, the framework 17 is arranged parallel with the framework 18, too. In this embodiment, the frameworks 17 & 18 are made of glass fiber reinforced epoxy resin or aluminum alloy, which thus are harder than the main body 10.

Figure 4:
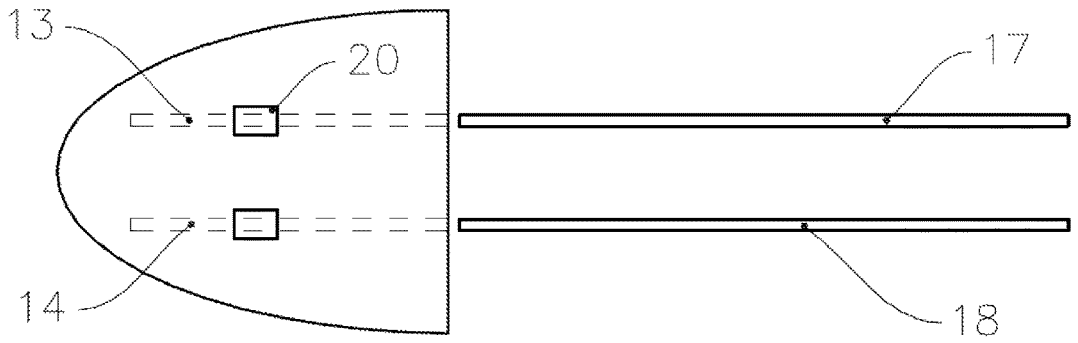
FIG. 4 is a schematic view of the first portion and the framework of the main body in the first embodiment of the present invention.
Figure 5:
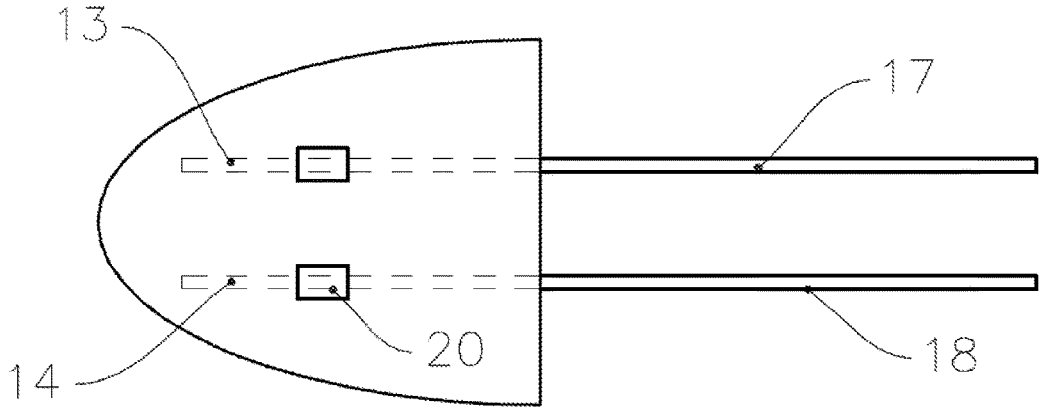
FIG. 5 is a schematic view of the first embodiment of the present invention after the first portion of the main body is inserted to the framework.

As shown in FIG. 4 and FIG. 5, the framework 17 and the framework 18 may be inserted into the slots 13 & 14 of the first portion 11 from the end face of the first portion 11 that is adjacent to the second portion 12. Preferably, the frameworks 17 & 18 are tightly fit with the slots 13 & 14 respectively, thereby firmly fixing the frameworks 17 & 18 into the slots 13 & 14.

Figure 6:
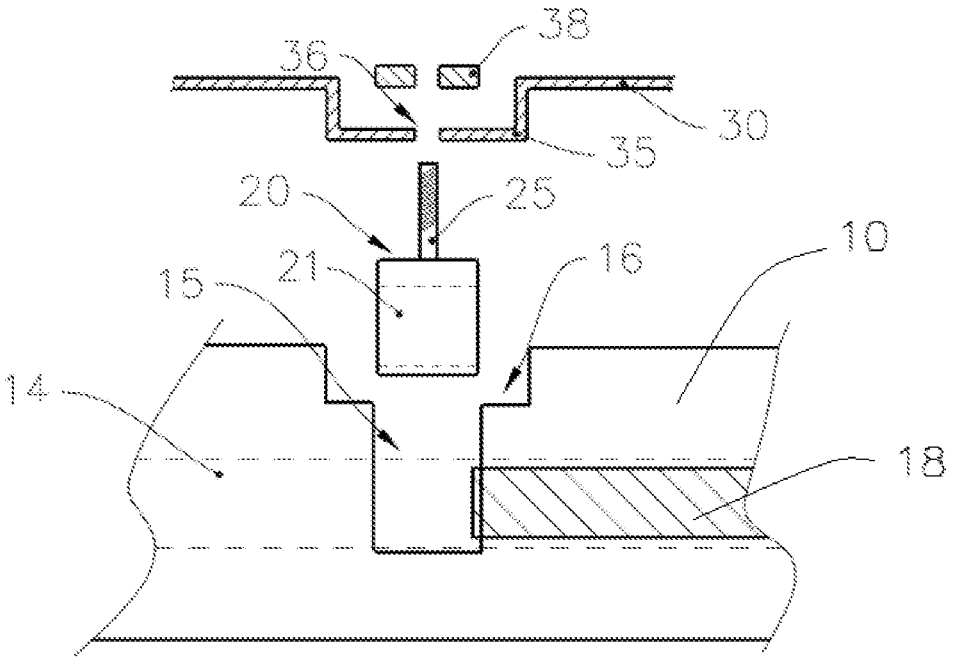
FIG. 6 is an enlarged schematic view of the first embodiment of the present invention when the locking members are mounted to the main body.

In order to firmly fix the frameworks 17 & 18 and the deck 30 onto the main body 10, a plurality of locking members 20 are provided in this embodiment to fix the frameworks 17 & 18 and the deck 30 onto the main body 10. Therefore, as shown in FIG. 6, a plurality of installation slots 15 are arranged on the main body 10 and located inside the slots 13 & 14 respectively. Hence, when the frameworks 17 & 18 are inserted into the slots 13 & 14, they also pass through the installation slots 15.

Figure 7:
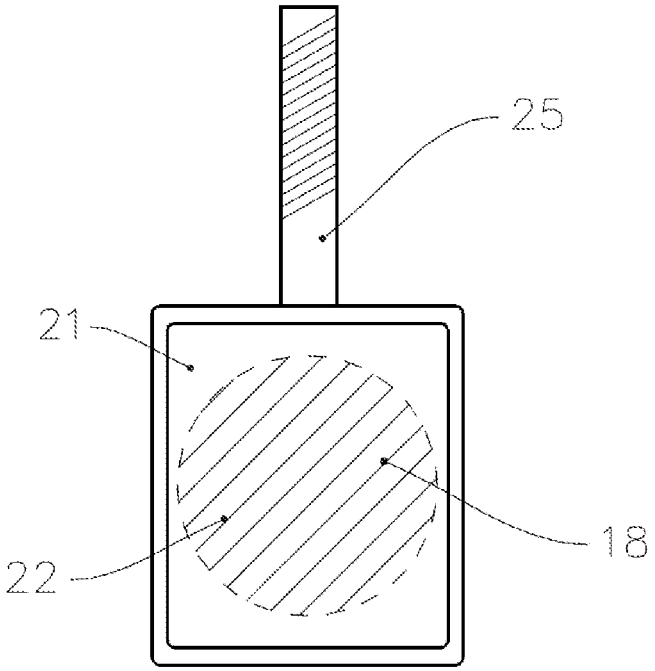
FIG. 7 is a sectional view of the locking members and the framework.
Figure 8:
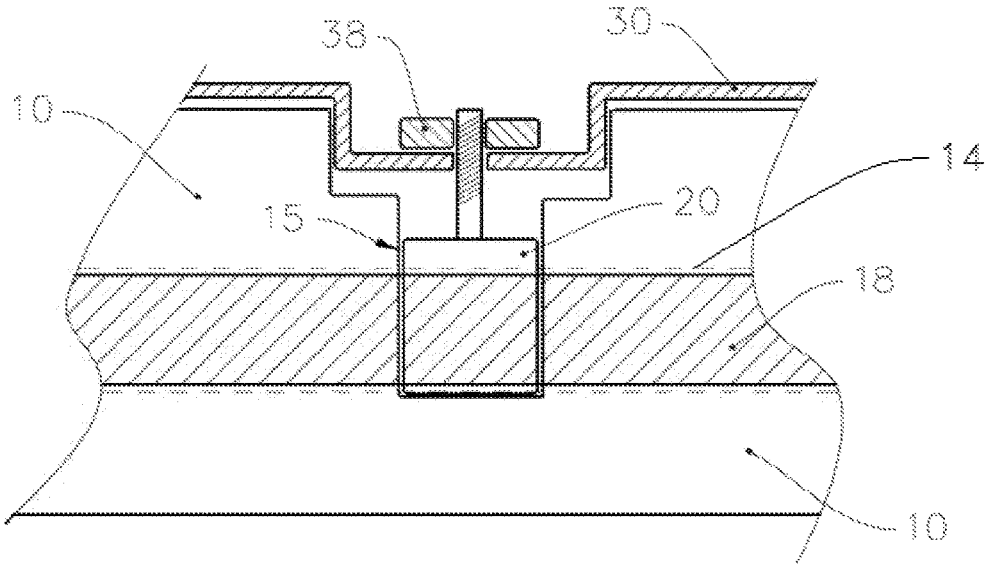
FIG. 8 is a local schematic view of locking members shown in FIG. 6 after they are mounted to the main body.

Every installation slot 15 is provided with a locking member 20. All locking members 20 have a same structure. The locking member 20 comprises a lock body 21 substantially in a rectangular shape. As shown in FIG. 7, there is a through hole 22 inside the lock body 21, and the framework 18 may pass through the through hole 22. In this embodiment, the cross section of the framework 18 is round, so the cross section of the through hole 22 is round, too. Preferably, the inner diameter of the through hole 22 is slightly greater than the outer diameter of the framework 18 so that the framework 18 can smoothly pass through the through hole 22. As the lock body 21 is rectangular, the installation slot 15 is a rectangle, too. As shown in FIG. 8, the lock body 21 can be completely mounted inside the installation slot 15. Further, a screw 25 is arranged at the upper end of the lock body 21, and exposed over the installation slot 15. Further, external thread is arranged on the screw 25, and a nut 38 may be screwed into the screw 25.

Figure 9:
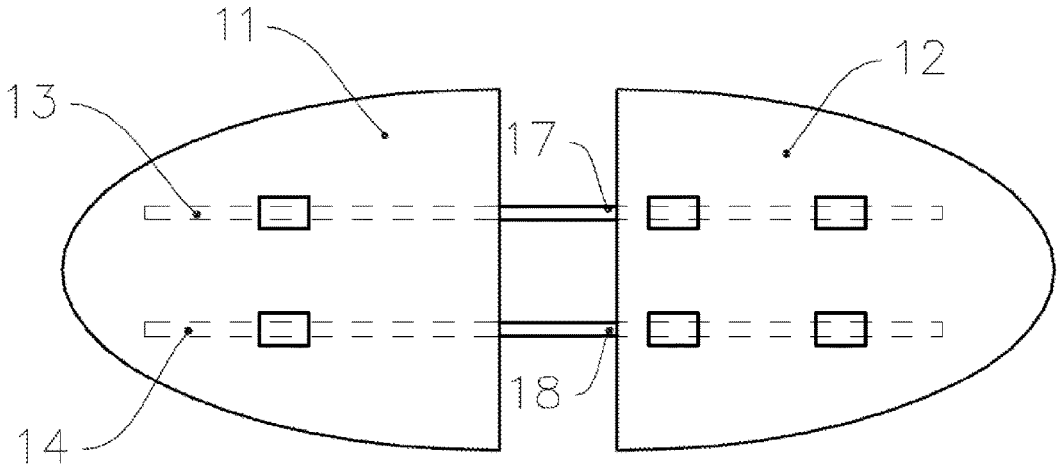
FIG. 9 is a schematic view of the second portion of the main body that is pieced together with the first portion in the first embodiment of the present invention.
Figure 10:
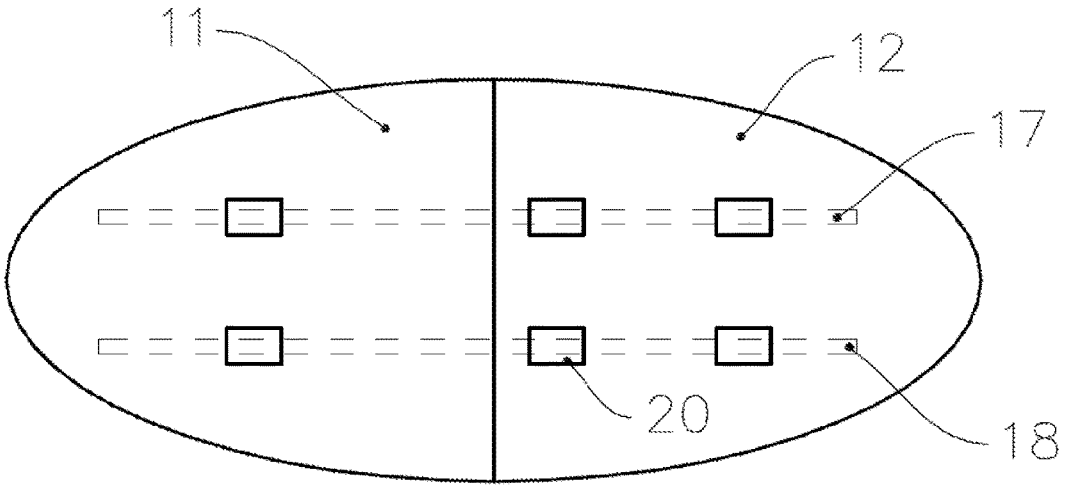
FIG. 10 is a schematic view of the main body in the first embodiment of the present invention.

During assembly of sports equipment, firstly the frameworks 17 & 18 are mounted inside the main body 10. As shown in FIG. 4 and FIG. 5, after the frameworks 17 & 18 are inserted into the slots 13 & 14 in the first portion 11, they pass through the through holes 22 in the lock bodies 21 in the first portion 11. In this way, part of the frameworks 17 & 18 is exposed outside the first portion 11. Then, as shown in FIG. 9 and FIG. 10, the slots 13 & 14 of the second portion 12 face directly the exposed ends of the frameworks 17 & 18, and then the second portion 12 is pushed to the direction of the first portion 11 so that the second portion 12 is pieced together with the first portion 11 to form an integral main body 10. The frameworks 17 & 18 pass through the through holes 22 in the lock bodies 21 in the second portion 12.

Figure 11:
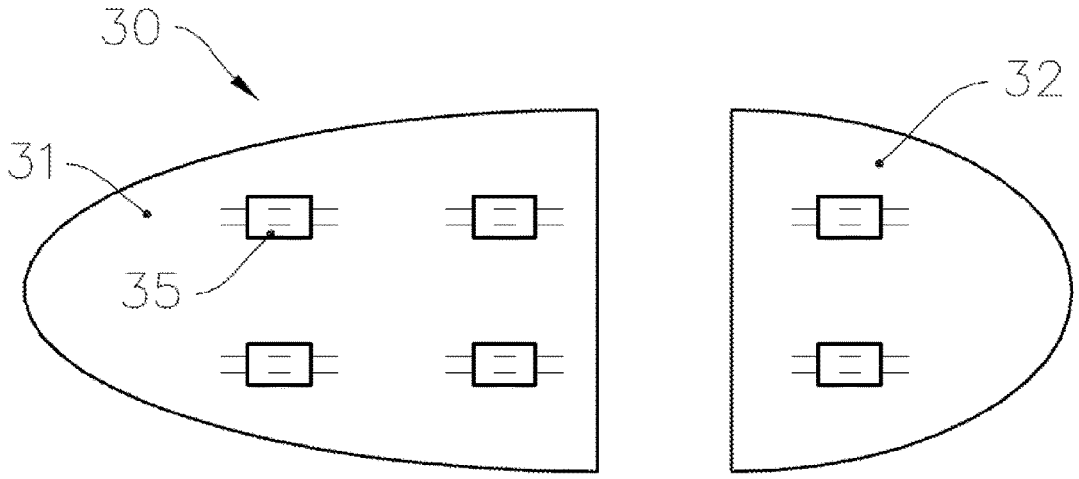
FIG. 11 is a schematic view of the first deck and the second deck in the first embodiment of the present invention.
Figure 12:
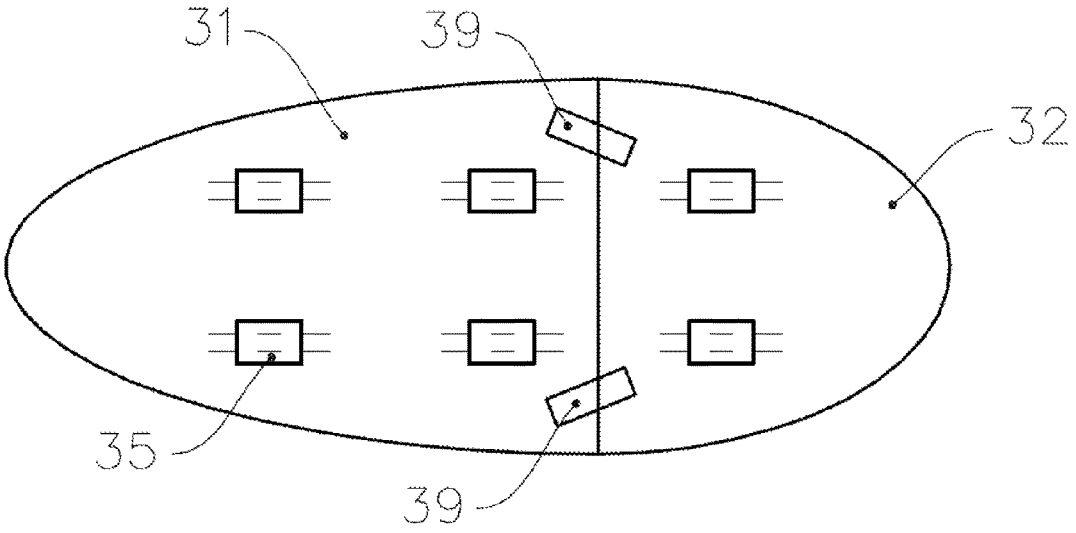
FIG. 12 is a schematic view of the deck in the first embodiment of the present invention.

The deck 30 is fixed on the upper surface of the main body 10. As shown in FIG. 11, the deck 30 in this embodiment comprises a first deck 31 and a second deck 32. As shown in FIG. 12, the first deck 31 and the second deck 32 are connected together via two connecting rods 39, hereby forming an integral deck 30. Of course, the connection between the first deck 31 and the second deck 32 should be detachable. In other words, the connecting rods 39 may be removed, hereby separating the first deck 31 from the second deck 32. In this way, the first deck 31 and the second deck 32 may be assembled or disassembled. For example, a specific angle is formed between two connecting rods 39, and by inserting them into the left and right receiving holes of the decks 31 & 32 from different angles, the decks 31 & 32 are firmly connected to make for the assembly and disassembly of the deck 30. Of course, the connecting rods in this embodiment are only an example, and the first deck may be coupled with the second deck by other detachable connection methods or connectors well known in the art.

In this embodiment, in order to realize positioning between the deck 30 and the main body 10, a plurality of positioning bulges 35 are arranged on the deck 30. Correspondingly, a plurality of positioning grooves 16 are arranged on the main body 10. As shown in FIG. 6 and FIG. 8, the positioning grooves 16 are on the surface of the main body 10, and sunken downward from the surface of the main body 10. Preferably, the installation slots 15 are under the positioning grooves 16 and narrower than the positioning grooves 16 so that the locking members 20 may pass through the positioning grooves 16 and be mounted inside the installation slots 15.

The positioning bulges 35 of the deck 30 are extended downwards from the surface of the deck 30, and every positioning bulge 35 corresponds to a positioning groove 16. Therefore, the width of the positioning bulges 35 is slightly smaller than that of positioning grooves 16. Further, a through hole 36 is provided in the middle of each positioning bulge 35, and the screw 25 of the locking members 20 passes through the through hole 36 and is extended upwardly. On the screw 25, a nut 36 may be screwed in. Preferably, the nut 36 is above the deck 30, i.e., a nut 38 is screwed into the screw 25 from above the deck 30. As shown in FIG. 8, after the nut 38 is screwed into the screw 25, the deck 30 and the frameworks 17 & 18 may be fixed to the main body 10 to form an integral body.

Figure 13:
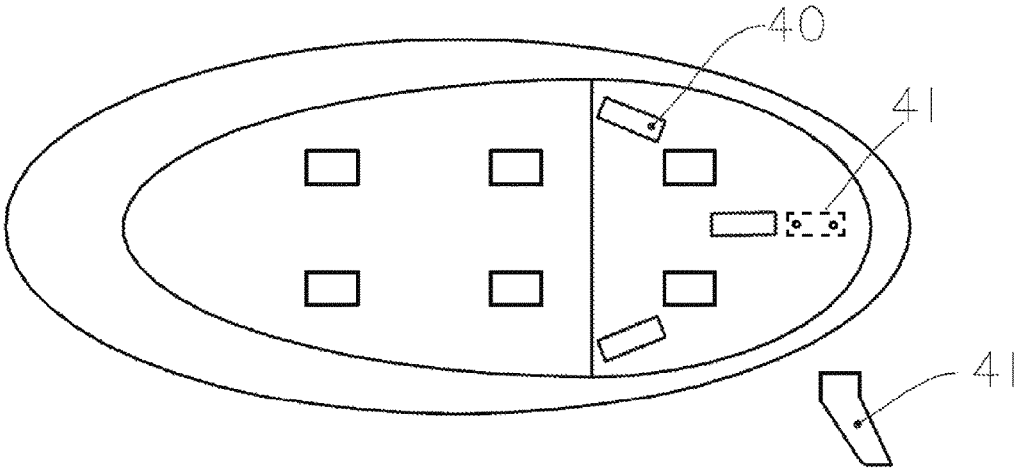
FIG. 13 is a schematic view of the first embodiment of the present invention after mounting of accessories.
Figure 14:
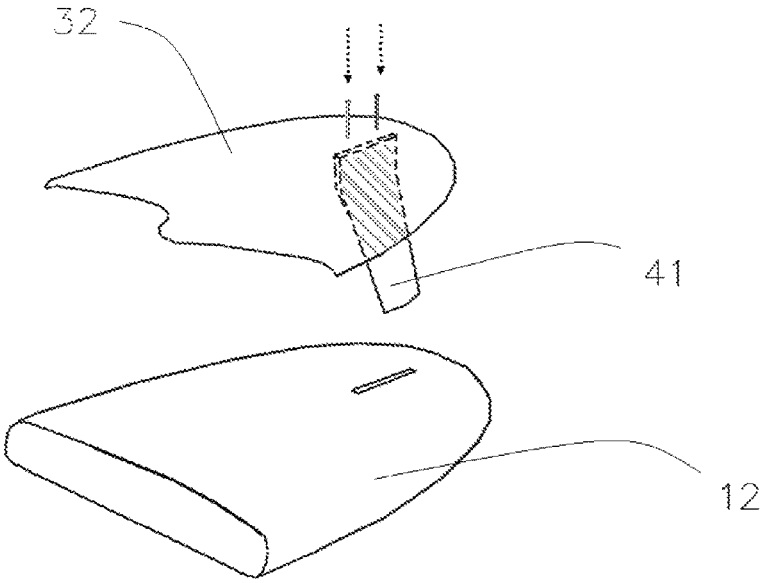
FIG. 14 is a schematic view of the first embodiment of the present invention after mounting of accessory tail fin.

Of course, the sports equipment typically needs to be provided with a plurality of accessories, such as a number of foot muffs and tail fins. These accessories may be fixed on the deck 30. As shown in FIG. 13 and FIG. 14, after the deck 30 is fixed on the main body 10, accessories, such as foot muffs 40 and tail fins 41, may be mounted on the deck 30, a number of threaded holes are reserved on the deck 30, screws, etc. are used to fix foot muffs and tail fins on the deck 30, and the tail fins pass the holes reserved on the main body 10 and stick out of the main body 10. As the material of the deck 30 is hard, accessories fixed on the deck 30 are not easy to fall off from the deck 30. Further, as the deck 30 is fixed on the main body 10 via the locking members 20, the accessories are also equivalent to being fixed on the main body 10.

Embodiment 2

The sports equipment in this embodiment is a kite board. As the kite board has a small volume, it is not necessary to design the main body in two sections.

Figure 15:
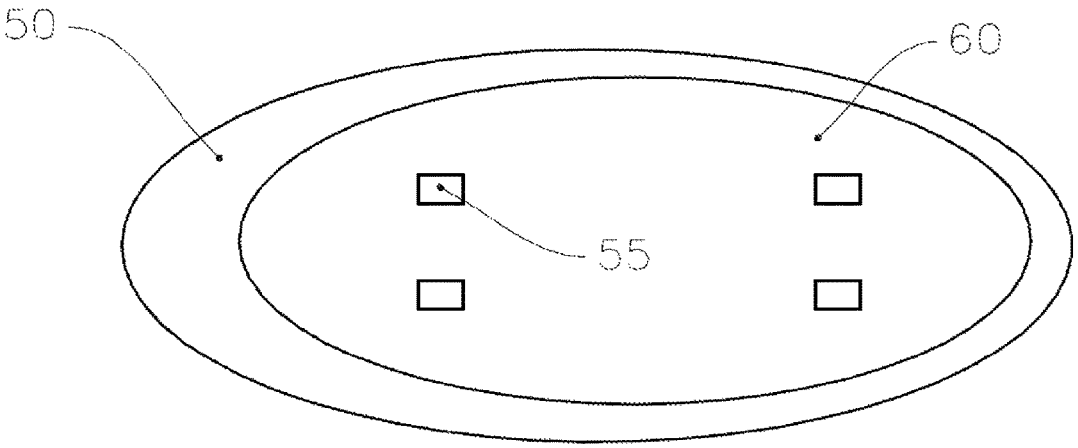
FIG. 15 is a schematic view of the second embodiment of the present invention.
Figure 16:
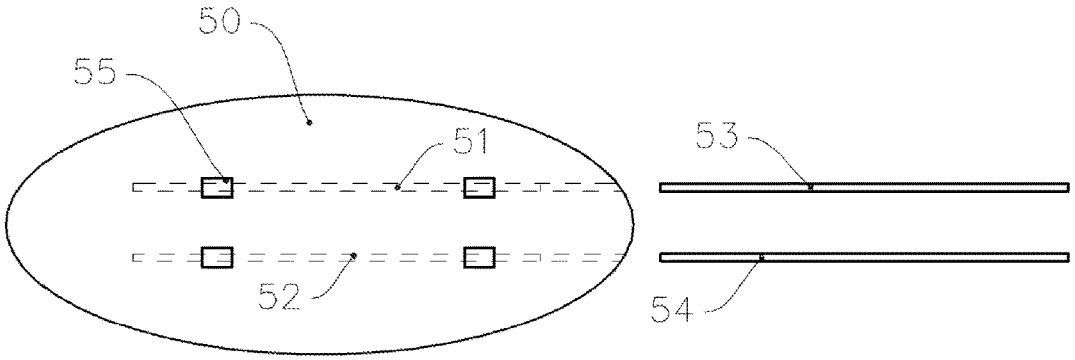
FIG. 16 is a schematic view of the main body and the framework in the second embodiment of the present invention.

Accordingly, it is not necessary to design the deck in two sections, either. As shown in FIG. 15, the sports equipment comprises a main body 50 made of foam material. As shown in FIG. 16, two slots 51 & 52 are arranged inside the main body 50 and both are concealed in the main body 50, that is, the slots 51 & 52 shouldn't be seen on the surface of the main body 50.

Figure 17:
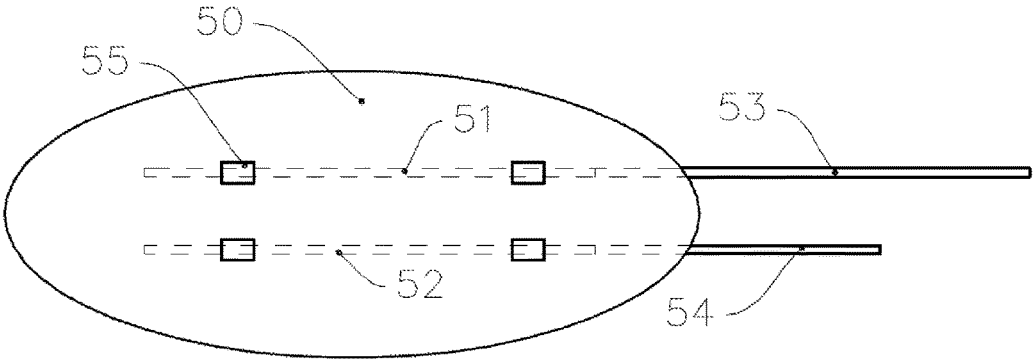
FIG. 17 is a schematic view of the main body and the framework in the second embodiment of the present invention in an alternative state.

In order to enhance the hardness of the main body 50, two frameworks 53 & 54 are arranged inside the main body 50, and inserted into the slots 51 & 52 respectively. In this embodiment, the frameworks 53 & 54 may be made of glass fiber reinforced epoxy resin or aluminum alloy to ensure they are harder than the main body 50. Therefore, the slots 51 & 52 may have openings on the side face of the main body 50. As shown in FIG. 16 and FIG. 17, the frameworks 53 & 54 may be inserted into the slots 51 & 52 from a side of the main body 50, and pass through the through holes of the lock bodies in the main body 50.

A deck 60 is arranged on the main body 50 and made of hard material, such as glass fiber reinforced epoxy resin. As the main body 50 does not adopt a two-section structure, it is not necessary for the deck 60 to adopt a two-section structure, either, and an integral structure may be adopted. In order to fix the deck 60 and the frameworks 53 & 54 on the main body 50, a plurality of installation slots may be arranged on the main body 50, and all are on the slots 51 & 52. A locking member may be arranged in each installation slot. The structure of the locking members is same as the structure of the locking members in the first embodiment, i.e., comprising a lock body in which a through hole is arranged, and the frameworks 53 & 54 can pass through the through holes of the locking members.

Figure 18:
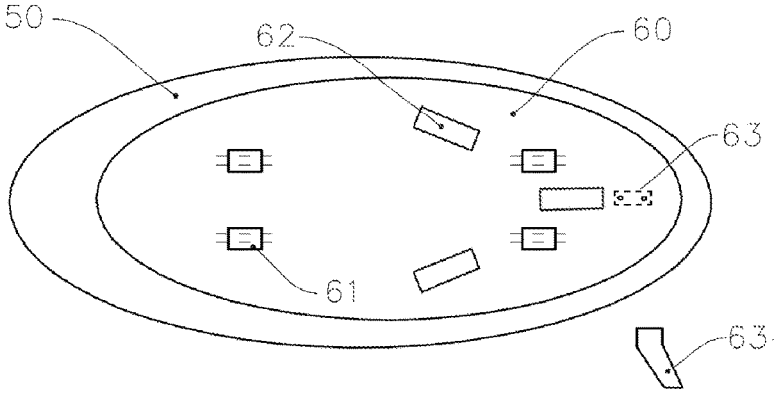
FIG. 18 is a schematic view of the second embodiment of the present invention after mounting of accessories.

Further, a plurality of positioning depressions 55 are arranged on the main body 50, and a plurality of positioning bulges 61 are arranged on the deck 60. As shown in FIG. 17 and FIG. 18, each positioning bulge 61 may be mounted inside a positioning depression 55. Preferably, each positioning depression 55 is over an installation slot so as to ensure the locking members are under the positioning grooves and the positioning bulges 61. Further, screws are arranged on the locking members, the upper end of each screw may pass through a positioning bulge 61 of the deck 60, and lastly, nuts may be used to lock the screws, hereby fixing the deck 60 and the frameworks 53 & 54 inside the main body 50 to form an integral body.

Of course, a plurality of accessories may be arranged on the deck 60. As shown in FIG. 18, accessories, such as foot muffs 62 and tail fins 63, may be mounted on the deck 60. They may be fixed on the deck 60 with screws or rivets for example. As the deck 60 is hard, accessories fixed on the deck 60 may avoid disengagement. Further, the deck 60 is fixed on the main body 50, too, so the accessories are equivalent to being fixed on the main body 50.

Apparently, the main body of the sports equipment provided in the present invention is made of foam material, which has the advantages of non-absorption of water, stable physical properties, resistance to acids and alkalis, long service life, high elasticity, and resistance to collision, long-time seawater erosion, UV light, and low and cold temperature, and meets the requirements for water and snow sports. Further, in order to enhance the hardness of the sports equipment, a framework is arranged inside the main body and made of glass fiber reinforced epoxy resin or aluminum alloy, a hard deck is arranged on the main body and made of glass fiber reinforced epoxy resin, and the materials of the framework and the deck are both stable and durable.

Further, the production process of the sports equipment provided in the present invention is simpler than that of the existing sports equipment of a kind, and can greatly reduce the chances of mistakes. In the existing production method, the casing of the main body is made of engineering fiber and thermosetting plastic. The chemical forming process of the thermosetting plastic is very sensitive to the changes of temperature, humidity and other climatic and environmental factors, which often result in incomplete chemical reaction, causing a high product rejection rate. Further, in the existing production process of sports equipment, manual work accounts for a large percentage, the procedures are complicated, the control of time shall be very accurate and the doses of chemicals must be accurate, so the manufacturing workers must have certain level of skill and concentration. Excessive dependence on manual work often leads to rejects due to human negligence or mistakes.

In comparison, the sports equipment provided in the present invention mainly uses foam material to make the main body. The main body may be made in a die by method of injection molding or compression molding. The production processes of decks, frameworks and other modular pieces are mainly completed by machine, which have lower dependence on human hands and are little affected by environmental factors. The assembly of finished products only needs a few simple manual steps, greatly reducing the product rejection rate caused by human factors.

Further, the present invention also solves the problems with durability and repair of sports equipment. The casing of the existing sports equipment is made of engineering fiber and thermosetting plastic. In order to meet the requirements for light weight, the casing is thin. It is highly likely to damage in case of collision. The production method of the existing sports equipment refers to the principle of imitating the integral structure of eggs in order to achieve light weight and firmness in a large volume. The casing and the foamed core need to be formed synchronously to realize integration of a tight structure. Just for this reason, when the casing is broken, although it is repaired, the complete integral structure has been destroyed and no longer existed. The repaired location is a source of subsequent damage expansion. Eventually, the sports equipment will face overall scrapping. Further, the repair equipment of fiber reinforced plastic requires specialized technologies and the repair cost is high.

In comparison, the main body of the sports equipment provided in the present invention has very high elasticity. It is not easy to damage by collision and highly durable and rarely needs repairing. In addition, the main body consists of a few sections. Even if one section is too badly broken to be mended, only this section needs to be replaced. The sports equipment will then resume to normal state and the whole equipment won't be scrapped. The sports equipment provided in the present invention is superior to the existing sports equipment in the aspects of durability and repair.

Alternatively, in the above embodiments, the framework may consist of a plurality of sections. For example, the framework is made up of two sections, and each section of the framework is put inside a section of the main body. Or, even if the main body is an integral body, the framework may still consist of two or more sections.

Figure 19:
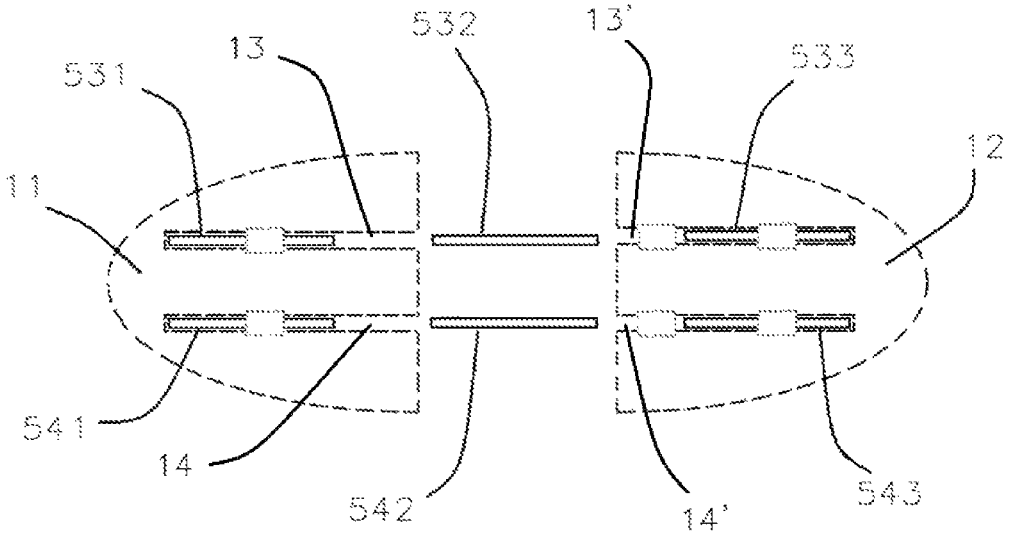
FIG. 19 is a schematic view of a variation of the framework in the first embodiment of present invention.

For another example, in the first embodiment, the framework consists of three sections. As shown in FIG. 19, the head section 531, 541 and the tail section 533, 543 of the framework are arranged inside the slots 13, 13', 14, 14' of the first portion 11 and the second portion 12 respectively, and the middle section 532, 542 is arranged inside the corresponding slots 13, 13', 14, 14' of the first and second portions at the same time.

Alternatively, in the above embodiments, no matter whether the main body and the deck are integral or segmented, fixation and connection methods may be adopted, including physical or chemical methods, to fix the hard deck to the top surface of the main body, while the framework may be pre-arranged inside the main body. It is only necessary to connect the segmented main body and deck together.

In the above embodiments, the connection and positioning between the deck and the main body are not limited to the above description and may also adopt other forms of fixing members.

Further, the present invention is advantageous in the aspects of transport and carriage. The existing sports equipment is integral and bulky, not easy to handle and carry. Moreover, in order to protect the fragile and weak casing from collision, it usually needs thick and heavy protective packaging during transport, increasing both volume and weight and making the carrying more difficult. The sports equipment provided in the present invention may be split into a plurality of short and small modules. The user may handle and carry them separately. For example, they may be put into the limited space of a car cabin or trunk and transported by public transport means. Further, as the main body is highly elastic, it does not need extra protective packaging and its volume and weight are not increased.

Meanwhile, the sports equipment provided in the present invention is more easily moved. As the existing sports equipment is a bulky and integral piece, the user must be strong enough in order to carry it from a storage location or a car park to a use site. In comparison, the product provided in the present invention can be split into smaller modules and carried by times, so even weak women or kids can easily carry them.

The sports equipment provided in the present invention not only improves the abovementioned defects of the existing sports equipment but also has the following advantages:

The first is the advantage in overseas or local transport. Compared with the existing sports equipment, it is similar in terms of overall weight and volume, but logistic transport and air consignment have limitation to the length of packages. The existing sports equipment is an integral piece and exceeds the length limit in general, so it is not accepted by transporters, while the sports equipment provided in the present invention can be split into smaller modular pieces and kept in a plurality of packages within the length limit, so it is accepted in logistic transport and air consignment. Furthermore, the main body is highly elastic and not easy to damage by collision, thick and heavy protective package as required by the existing sports equipment is not needed. Small volume and weight can also save freight.

The second is the advantage in storage. The existing sports equipment is an integral piece with a large volume and has certain requirements for storage space. In comparison, the sports equipment provided in the present invention may be split into smaller modular pieces and stored in the limited and scattered spaces of your home. Further, the main body is not easily damaged by collision and has lower requirements for storage conditions.

The third is the advantage for using habitual equipment during travel. Travelers often hope to use the equipment they often use to avoid renting unfamiliar equipment to which they must adapt. As the existing sports equipment is a bulky and integral piece and liable to damage during transport, it is not suitable for carriage and use during travel. In comparison, the product provided in the present invention is split into smaller modular pieces, and its main body is not easily damaged by collision, it can be consigned as conveniently as baggage and is suitable for use at the destination. The users can use the sports equipment they are familiar with.

The fourth is the advantage of being safe to adjacent users on water. As the exposed part of the sports equipment provided in the present invention is soft foam plastic material, not hard material. When it is used on the water with many people, it reduces the chance of injury of other swimmers due to collision.

The fifth is the advantage of allowing convenient and free addition of accessories. Whether the accessories are mounted by drilling a plurality of holes on the hard deck or the main body, no water will enter the main body as the existing sports equipment encounters, which will lead to increase of the weight of the equipment. When holes are drilled on the existing sports equipment to install accessories, it is complex and expensive to prevent the entry of water. It is not as convenient and easy as the present invention when installing accessories on the existing sports equipment.

The sixth is the advantage of being more suitable for amusement light boats carried by yachts and sailboats than the existing sports equipment. The sports equipment provided in the present invention can be split into small modular pieces, has lower requirements for storage space and can be elastically put into the limited spaces of yacht and sailboat cabins. Moreover, the main body is made of soft and light foam material. When the yacht or sailboat is tossed in waves, the collision from loosened sports equipment won't damage the boat or injure users. Owing to its low requirements for storage space and safety of soft material, it is more suitable than the existing sports equipment for amusement light boats carried by yachts and sailboats.

Lastly it should be stressed that the present invention is not limited to the foregoing embodiments. For example, according to actual need, the main body or deck is divided into three sections or more sections of modules, or one framework or three or more frameworks are arranged inside the main body, or different shapes of frameworks are adopted, or the deck for the mounting of accessories is not on the surface of the main body but sandwiched in the main body. Such changes should also be included in the protective scope of the claims of the present invention.

What is claimed is:

1. A watersports board, comprising:

a main body made of foam material;

a deck fixed on the top surface of the main body and configured to be harder than the main body;

at least one framework located in the main body and configured to be harder than the main body;

wherein the main body comprises a first portion and a second portion, which are connected in a detachable manner, the first portion and the second portion are provided with at least one slot respectively, and the framework is mounted in the slot of the first portion and the slot of the second portion; and the deck comprises a first deck and a second deck, which are connected in a detachable manner;

wherein the main body is fixed and connected to the deck by fixing members in a detachable manner;

wherein positioning grooves are arranged on a top surface of the main body, and positioning bulges are arranged on a bottom surface of the deck, which are buckled with the positioning grooves.

2. The watersports board according to claim 1, wherein the framework is arranged to tightly fit with the slot of the first portion and the slot of the second portion for inserting into the slot of the first portion and the slot of the second portion the framework and the slots are extended along a length direction of the main body.

3. The watersports board according to claim 2, wherein the main body together with the framework is fixed and connected to the deck by locking members in a detachable manner.

4. The watersports board according to claim 3, wherein the main body is provided with grooves for receiving the locking members, and a through hole is arranged in a middle part of each of the locking members to allow the passage of the framework; and a screw is arranged on a side of each of the locking members facing towards the deck, which is configured to pass through the corresponding holes arranged on the deck and is fastened onto the deck by a nut.

5. The watersports board according to claim 2, wherein the sports equipment has two frameworks, which are separately mounted in the two slots that are arranged on the main body and extend parallel along the length direction of the main body.

6. The watersports board according to claim 5, wherein each of the frameworks consists of a head section, a middle section and a tail section, the head section and the tail section are arranged in the first portion and the second portion of the main body respectively and the middle section is mounted in the first portion and the second portion.

7. The watersports board according to claim 1, wherein at least one accessory is mounted on the deck directly or after passing through the main body.

8. A watersports board, comprising:

a main body made of rigid material;

a deck fixed on a top surface of the main body and configured to be harder than the main body;

at least one framework located in the main body and configured to be harder than the main body;

wherein the main body is fixed and connected to the deck by fixing members in a detachable manner;

wherein the framework is in an elongated shape, and the main body is provided with elongated slots extending in a length direction for receiving the framework;

wherein the fixing members are locking members, by which the main body together with the framework is fixed and connected to the deck;

wherein the main body is provided with grooves for receiving the locking members, and a through hole is arranged in a middle part of each of the locking members to allow the passage of the framework; and wherein a screw is arranged on a side of each of the locking members facing towards the deck, which pass through the corresponding hole arranged on the deck and is fastened onto the deck by a nut.

9. The watersports board according to claim 8, wherein the main body is made of foam material.

* * * * *